US005556045A

United States Patent [19]

Johnson et al.

[11] Patent Number: 5,556,045

[45] Date of Patent: Sep. 17, 1996

[54] PROCESS FOR PRODUCING TAPERED WINDINGS OF THREAD WITH SPOOL SPEED CONTROL

[75] Inventors: Timothy Johnson, Vimines; Patrick Moireau, Curienne, both of France; Gunther Mager, Stolberg, Germany

[73] Assignee: Vetrotex France, S.A., Chambery, France

[21] Appl. No.: 224,531

[22] Filed: Apr. 7, 1994

[30] Foreign Application Priority Data

Apr. 8, 1993 [FR] France ..... 93 04166

[51] Int. Cl.[6] ..... B65H 54/02; B65H 54/28

[52] U.S. Cl. ..... 242/18 G; 242/26.3; 242/26.5

[58] Field of Search ..... 242/18 G, 158 R, 242/158.2, 26.5, 27, 26.1, 26.2, 26.3

[56] References Cited

U.S. PATENT DOCUMENTS

| | | | |
|---|---|---|---|
| 2,593,680 | 4/1952 | Lamb et al. | 242/26.5 |
| 2,764,363 | 9/1956 | Stammwitz | 242/26.2 |
| 2,858,993 | 11/1958 | Siegenthaler . | |
| 3,218,004 | 11/1965 | Meeske et al. . | |
| 3,367,588 | 2/1968 | Wolf | 242/26.3 |
| 3,373,945 | 3/1968 | Johnson | 242/26.3 |
| 3,847,579 | 11/1974 | Fulk et al. | 242/18 G X |
| 3,861,609 | 1/1975 | Klink et al. | 242/18 G X |
| 3,971,517 | 7/1976 | Matuura et al. | 242/26.3 X |
| 4,010,908 | 3/1977 | Patterson | 242/18 G X |
| 4,739,947 | 4/1988 | Anseel et al. | 242/26.1 X |
| 4,752,043 | 6/1988 | Heinzer | 242/18 G |
| 5,054,705 | 10/1991 | Smith | 242/18 G X |

FOREIGN PATENT DOCUMENTS

| | | |
|---|---|---|
| 0241964 | 7/1987 | European Pat. Off. . |
| 0437299 | 7/1991 | European Pat. Off. . |
| 2544337 | 7/1976 | Germany . |
| 238829 | 8/1945 | Switzerland . |
| 240770 | 10/1946 | Switzerland . |
| WO92/08664 | 5/1992 | WIPO . |

OTHER PUBLICATIONS

Patent Abstracts of Japan, vol. 7, No. 41 (M-194) (1186) 18 Feb. 1983 & JP-A-57 189 971 (Shinetsu Densen K.K.) Nov. 22, 1982.

*Primary Examiner*—Michael R. Mansen

*Attorney, Agent, or Firm*—Oblon, Spivak, McClelland, Maier & Neustadt, P.C.

[57] ABSTRACT

A process for producing tapered windings of glass threads consists, downstream from a drawing device of glass filaments joined into a thread, in making the thread pass to the end of the arm of a dancing roller, then winding it on a support attached by one of its ends to a rotationally driven spindle. The thread is distributed on said support with the help of a thread guide reciprocated in parallel to the axis of said support, so as to obtain a winding tapered over at least part of its height.

15 Claims, 3 Drawing Sheets

PROCESS FOR PRODUCING TAPERED WINDINGS OF THREAD WITH SPOOL SPEED CONTROL

BACKGROUND OF THE INVENTION

1. Field of the Invention

This invention relates to the production of windings of glass thread wound at constant speed, and in the form of tapered windings.

2. Description of the Related Art

Windings of thread are a common means of temporarily storing the thread. The threads can be in different forms: a single thread comprising one twist, twisted threads, etc. They are ultimately fed to textile machines operating at high speed. The thread must be able to be easily unwound while avoiding any friction that could cause a break. In this regard, tapered windings offer a particular advantage compared to other types of windings. In such a winding, the thread, carried along the axis of the winding in the direction of its smallest diameter, moves immediately away from the lateral edge of the spool as soon as a turn pulls away from it. The risk of a turn being held back by an adjacent turn or of the thread rubbing on the lateral edge of the winding is thus very small.

A large number of solutions have been proposed to achieve such windings. They can be produced by winding the thread with a thread guide that moves in a to-and-fro or reciprocal movement parallel to the axis of a tapered support, the latter being rotated by driving rollers initially applied thereto and then applied on the deposited layers of thread.

Some of the known solutions have the object of maintaining the winding speed of the thread approximately constant, despite the continuous variation in diameter of the support on which it is wound. For this it is necessary to make the rotation speed of the support vary so that the thread always encounters a surface whose peripheral speed is approximately constant. Since the support is put in rotation by driving rollers, the maintenance of peripheral speed can be achieved by the alternation of rapid braking and acceleration of said rollers.

A series of solutions using such a process are described in application EP-A-0 343 540, which itself proposes a particular solution.

The difficulties that must be overcome in using such a process are numerous and far from insignificant. Among the latter are the acceleration and braking of the driving rollers that must be perfectly controlled to avoid slipping between the two surfaces in contact. This risk limits the speed at which the thread can be wound; the above-cited document gives an example according to which the speed of the thread is 140 m/min.

Another difficulty is to prevent the pressure that the driving rollers unavoidably exert on the spool from destroying the thread. This is all the more difficult to avoid when the thread is sensitive to friction by its very nature; this is particularly the case with glass threads.

It must also be noted that it is not possible to wind a thread with driving rollers on a support provided with a lateral flange or edge at one of its ends.

Other solutions make it possible to avoid using driving rollers, such as for example the patent U.S. Pat. No. 3,218,004.

This patent describes a process that makes it possible to produce a tapered winding on a cylindrical support provided with a straight lateral flange or edge at each of its ends. This result is achieved by a concomitant variation in the speed of the thread guide and in the rotation speed of the spindle carrying the support. The variation in the speed of the spindle is caused by the variation of the driving torque, itself caused by the variation in the tension of the thread during its winding.

This process has a certain inertia and is applicable only to threads whose mechanical behavior makes it possible to absorb variations in tension, such as wires, but it is not applicable to threads that do not have this ability to absorb such variations in tension, such as glass threads.

SUMMARY OF THE INVENTION

This invention has as an object a process making it possible to obtain directly—from a spinneret from which continuous glass filaments, assembled in the form of a thread, are drawn—a tapered winding of said thread.

This invention has as a further object a process that makes it possible directly to obtain a tapered winding, whether the support on which the thread is wound is cylindrical or tapered.

The above and other objects of the invention are achieved by a process according to which the continuous glass filaments are drawn mechanically from a multiplicity of strings of molten glass coming from orifices of a spinneret, then are coated with a size and gathered into a thread that is carried by a drawing device, and that consists, downstream from this device, in making said thread move to the end of the arm of a dancing roller, then in winding it on a support attached by one of its ends to a rotatably driven spindle, and in distributing the quantity of thread deposited on said support with the help of a thread guide that moves in a reciprocal movement parallel to the axis of said support. A winding tapered over at least part of its height is obtained by giving a constant value to the speed of the thread in the drawing device, by programming the displacement speed of the thread guide and the length of its run, by continuously measuring the difference between the speed at which the thread is drawn, which is constant, and its winding speed, thanks to the displacement of the arm of the dancing roller, and by making the rotation speed of the spindle subject to the difference thus measured so that, for each run of the thread guide, said spindle rotation speed varies between two extreme values that decrease simultaneously from the start to the finish of the winding operation.

The rotation speed of the spindle can be controlled or regulated in different ways. Thus, it can, in real time, be made subject to the displacement of the arm carrying the dancing roller with a PID regulator connected to the motor of said spindle by a motor speed regulator.

It can also be subject to the displacement of the arm carrying the dancing roller with a PID regulator whose regulating parameters are programmed by a controller, said regulator being connected to the motor of the spindle by a motor speed regulator.

It can also be subject to the displacement of the arm of the dancing roller, whose signal is transmitted to a controller which, after conversion and calculation as a function of the programmed parameters, transmits in turn a signal to the speed regulator connected to the motor of the spindle.

To wind a certain layer "n" the rotation speed of the spindle can be controlled, by a motor speed regulator, by a programmed controller, said control being corrected after comparison with the signals transmitted to the controller by the arm of the dancing roller when layers n–1; n–2 . . . n–p are wound.

In the process according to the invention, the displacement speed of the thread guide for winding each layer of thread can vary between at least two extreme values from the start until the finish of the winding operation. Alternatively the speed of the thread guide can vary, for example, between two extreme values $v_1$ and $v_2$ for each layer wound from the start of the winding operation until a predetermined layer "n." For layers n+1; n+2 . . . until the end of the winding operation, the speed of the thread guide can stay constant between the points at which it turns back.

The variation of the speed of the thread guide and the concomitant variation of the rotation speed of the spindle thus make it possible to cause the length of thread wound on any part of the winding surface to vary, considered during at least part of the winding operation and located between two parallel planes separated by a centimeter and perpendicular to the axis of said winding, for all or some of the thread layers, depending on the tapered shape desired for the final winding. For convenience, the length of thread wound on the part of the surface defined above will be called "length of thread per centimeter" in the rest of the description. Since the tapered shape can be produced by the programmable parameters alone of the winding operation, the thread can be wound on a cylindrical support as well as on a tapered support. This support can comprise, at one of its ends, a straight lateral edge or a tapered lateral edge. The process according to the invention thus makes it possible, directly from a spinneret, to make different tapered windings of glass thread.

Thus, according to the invention, the speed of the thread guide can stay constant between the points at which it turns back from the beginning to the end of the winding operation. In this case, the thread is wound on a tapered support.

According to the invention, it is also possible to make a tapered winding by winding superposed layers of a thread on a cylindrical support, formed from internal layers wound at the start of the winding operation in which the length of thread wound per centimeter varies from the top to the base of the winding and from external layers exhibiting a constant length of wound thread.

The height of the thread layers whose tapered winding is formed can decrease progressively from the first layers wound on the support up to the layer forming the periphery of said winding.

Thus a tapered winding can be obtained by winding superposed layers whose height decreases progressively from the first layers wound on the selected support winding up to the layer forming the periphery of the winding. Depending on whether the selected support is cylindrical or tapered, the speed of the thread guide varies or stays constant between the points at which said thread guide turns back.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figures 3, 3A:
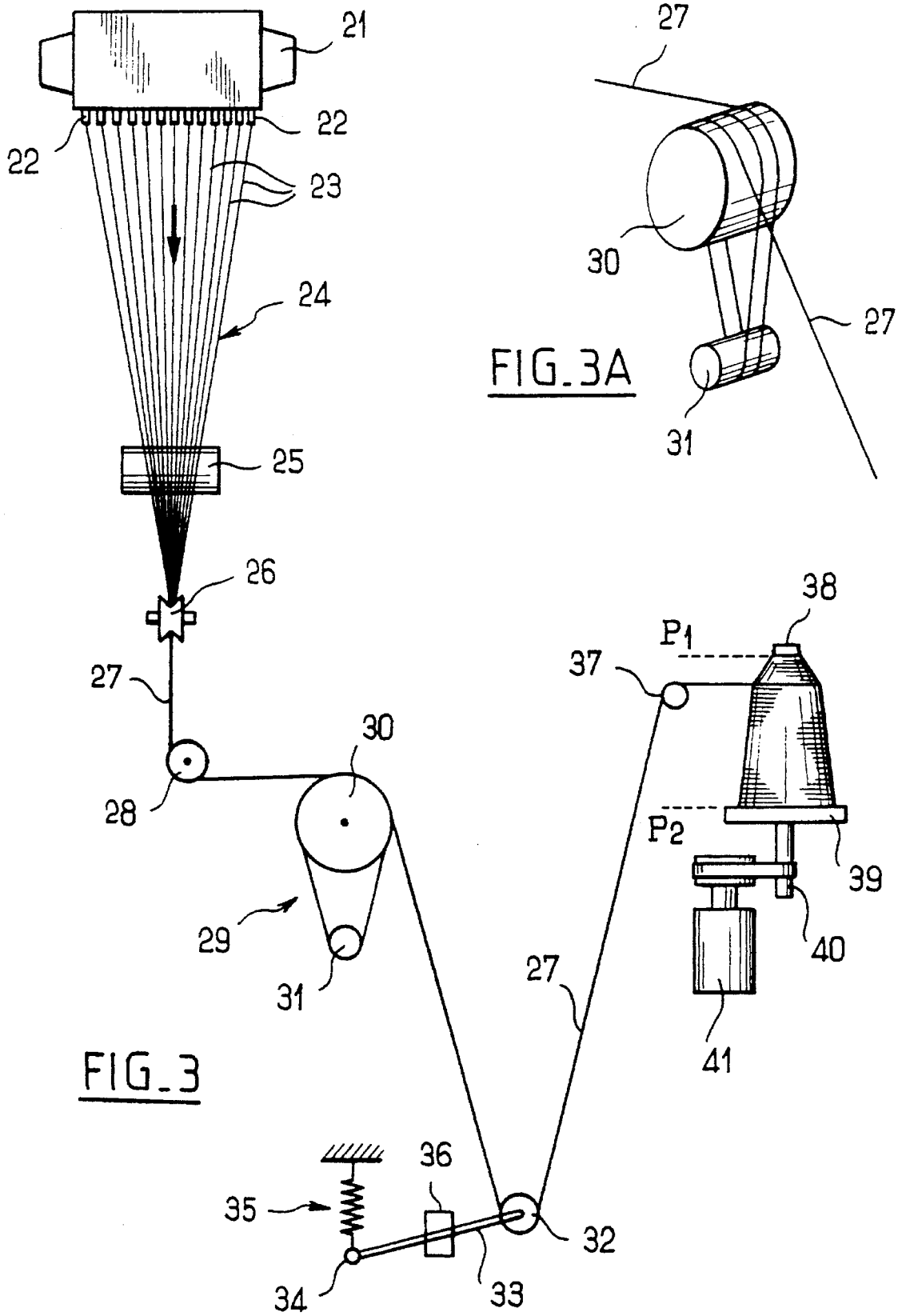
FIG. 3 is a diagrammatic view of an installation making it possible to use the process according to the invention.
FIG. 3*a* is diagrammatic view of a part of the installation illustrated by the preceding figure.

The process according to the invention can be used within the framework of an installation such as the one illustrated in FIG. 3.

This installation comprises a spinneret 21, shown schematically, which is normally connected to a glass feed source. This source (not shown) can be the forehearth of a furnace that distributes the molten glass to several spinnerets, similar to spinneret 21, fed by gravity. Spinneret 21 can instead be fed with cold glass obtained and stored in the form of balls in a hopper placed above the spinneret.

Spinneret 21 is generally made of platinum-rhodium alloy and is heated by the Joule effect. This spinneret makes it possible to remelt the glass or to keep it at a temperature sufficient for a viscosity suitable for drawing it in the form of continuous filaments. The molten glass flows out of a multiplicity of orifices, such as points 22, and is drawn immediately into a multiplicity of filaments 23, here gathered into a single layer 24. The filaments thus obtained have an average diameter generally between 5 micrometers and 14 micrometers.

This layer 24 comes into contact with the sizing device schematically shown at 25, so that each filament 23 is coated with size. This device 25 is fed continuously with a size that is picked up by the filaments 23, which glide on its surface. The deposited size is preferably made essentially of a mixture of organic products. This makes it possible to avoid the drying operation necessary when using size in the aqueous phase and the drawbacks that result from it. However, it is also possible, within the context of the process according to the invention, to use a size in the aqueous phase. In this latter case, the installation will include a device eliminating most of the water from the size deposited on the thread before it is wound. Such a device is described, for example, in U.S. Pat. No. 5,443,611.

Layer 24 converges toward assembly device 26 where the different filaments are united to produce thread 27. This device can consist of a simple grooved pulley or of a plate provided with a notch. Thread 27, after passing over a guide element 28 such as, for example, a grooved pulley, is carried along at constant speed by device 29 which eliminates speed fluctuations in the thread. This constant speed is generally equal to or greater than 10 meters per second.

The device 29, illustrated schematically in FIG. 3*a*, consists of a drawing wheel 30 driven by a motor (not shown) which forms a capstan, and by a separating roller 31 turning freely around its axis.

Thread 27 then passes into the groove of a dancing roller 32, turning freely around its axis and attached to the end of an arm 33. At other end 34 of the arm a device, such as a spring 35, gives thread 27 a predetermined tension. As soon as a difference between the drawing speed of wheel 30 and the winding speed of the thread appears, arm 33 pivots around its axis. This movement is immediately detected by a position detector 36.

Thread 27 is then wound with the help of a thread guide such as pulley 37. Pulley 37 is driven with a reciprocal movement between two positions $P_l$ and $P_2$, and distributes the thread on a support including a core 38 provided at its base with a straight lateral flange or edge 39. This support is fixed on a spindle 40 rotated by a motor 41.

Figure 4:
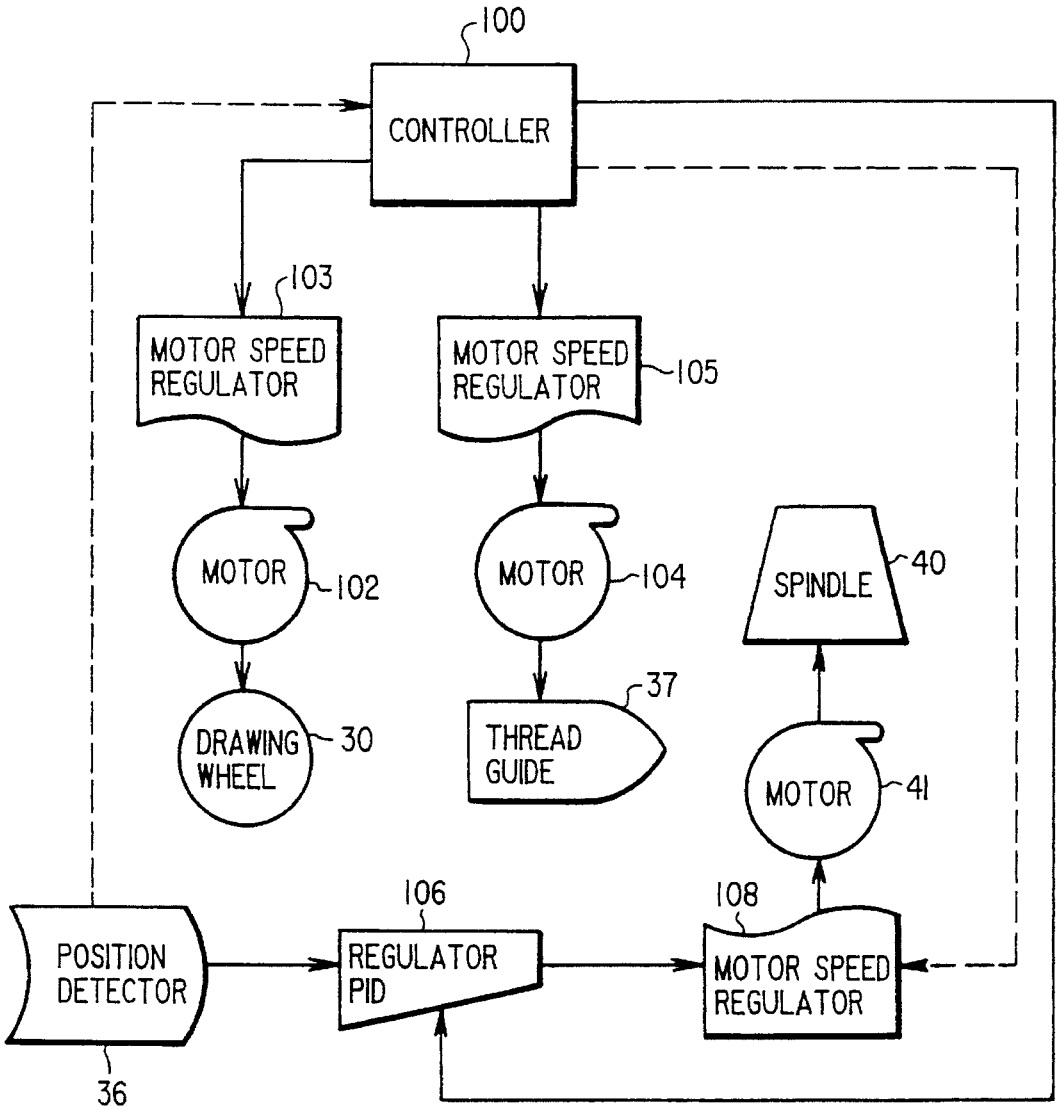
FIG. 4 is a diagram of the control device for regulating the devices providing the winding according to the invention.

The controller for regulating this installation is shown schematically in FIG. 4.

The controller 100 controls the motor 102 of drawing wheel 30, via motor speed regulator 103, so as to rotate at a constant speed, a condition that must be imperatively satisfied to obtain filaments 23 of constant diameter and thus a thread 27 with a constant titer. The controller 100 also controls the motor of the pulley 37, via the speed regulator 105, so as to give it displacement speed(s) and length of its travel that are maintained throughout the winding operation to obtain a winding of a certain structure. The programming of the length of travel makes it possible, for example, to progressively reduce the travel of the thread guide at the start of the winding operation to obtain the conical shoulder 13 shown in FIGS. 1 and 2. In the case of a winding on a support provided with a tapered lateral flange or edge (FIG. 2), this programming also makes it possible to modify the travel of the thread guide to wind the last turns of each layer at a level slightly less than that reached by the last turns of the preceding layer. It is thus possible to avoid the formation of an undesirable accumulation of turns in the zone at the end of travel of the thread guide. With a support provided with a tapered lateral edge, the winding can be formed solely from layers exhibiting a constant thread length per axial centimeter of the support from one end of the winding to the other.

The movement, or more exactly the rotation, of arm 33 of the dancing roller around its axis, caused by the appearance of a difference between the drawing speed and the winding speed of the thread, is transformed into an electric signal by a position detector 36 such as a potentiometer. This signal is transmitted to a PID regulator 106 having integral and derivative proportional operation. The parameters of this regulator can be established by potentiometers or programmed by the controller. The signal processed by the regulator is transmitted to a motor speed regulator 108 that controls motor 41 of spindle 40. It may be appreciated that when forming a tapered winding the rotating speed of the spindle decreases from the start to the finish of the winding operation, and that the winding speed also decreases as the thread approaches the flange.

The rotation of arm 33 of the dancing roller 32 can also be recorded by an encoder placed on its axis instead of a potentiometer. The signal of the encoder is transmitted to the controller 100. After calculation as a function of the programmed parameters, the information is transmitted to the motor speed regulator 108 that controls motor 41.

The preceding regulation is a reactive regulation in real time as a function of the displacement of the dancing roller 32. Provided there is a more complex programming, it can be of the digital-predictive type with analog corrections.

Thus the controller, after calculation as a function of programmable parameters, transmits a signal to the regulator 108 that controls motor 41. Any rotation of the arm of the dancing roller 32 is thus recorded by the encoder attached on its axis. The signal supplied by the encoder is transmitted to the controller 100. After calculation and correction, the controller transmits a modified signal to the motor regulator, etc.

Figure 1:
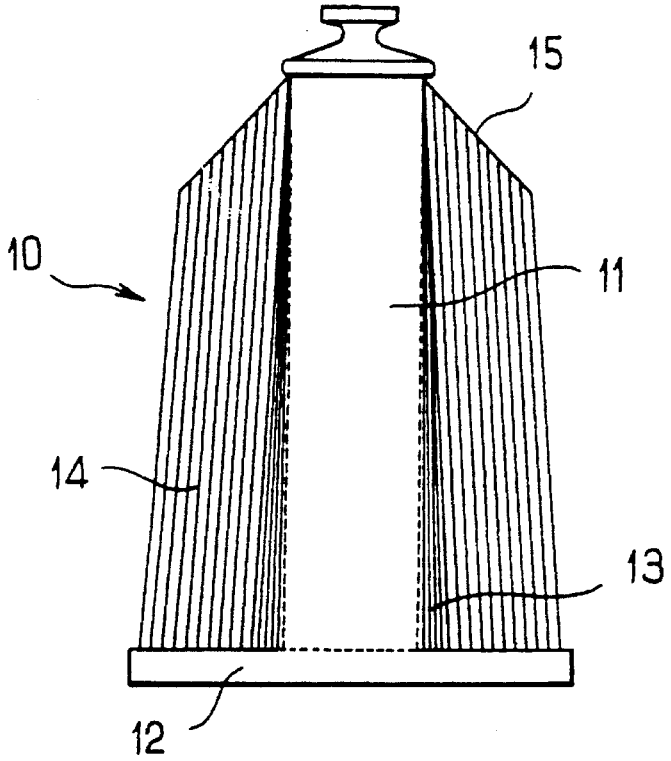
FIGS. 1 and 2 diagrammatically show, in lengthwise section, the internal structure of two different windings made according to the invention.
Figure 2:
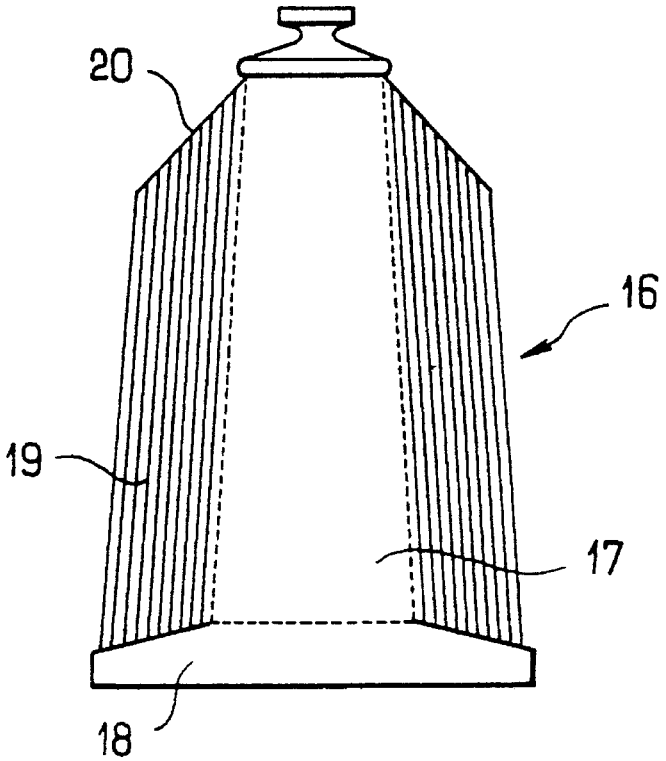

FIGS. 1 and 2 schematically illustrate two examples of windings of glass thread obtained according to the invention.

The winding of FIG. 1 has the following structure: each of the layers wound after the start of the winding operation exhibits a very large variation in the length of thread wound per centimeter of the length of the support, from the top of the winding up to its base. For example, the thread guide velocity is increased as it moves toward the top of the support. This is symbolized, in zone 13, by a series of layers whose thickness increases greatly from the top of cylindrical barrel 11 to the straight lateral flange or edge 12. This type of winding (i.e., that of zone 13) is performed until the desired tapered shape is obtained for the final winding. The following layers can then have a length of thread wound per centimeter that is constant over their entire height. This is symbolized by layers 14 of constant thickness. In reality, the thickness of these layers is not rigorously constant from the start to the finish of the winding operation. A very slight difference in the conicity of the winding can be observed during its enlargement. Winding 10 also has a conical shoulder 15.

FIG. 2 illustrates another type of winding 16 made on a tapered barrel 17 provided with a tapered lateral edge or flange 18. The wound layers have a length of thread deposited per centimeter that stays constant over their entire height. This is symbolized by layers 19 of constant thickness. This winding also has a tapered shoulder 20.

The accompanying table gives, by way of examples, the characteristics and production parameters for two kinds of tapered windings made according to the invention. These windings were obtained from a thread of 68 tex, formed from 408 glass filaments with an average diameter of 9 micrometers, drawn at 2220 meters per minute. The size deposited on these filaments has the following composition, expressed in percentages by weight:

| | |
|---|---|
| isobutyl stearate | 4.25% |
| silicone acrylate (sold under the name Ebecryl 1360 by the Union Chimique Belge company) | 14.25% |
| diacrylate carbonate (sold under the name Acticryl CL 993 by the Harcros company) | 14.25% |
| N-vinyl pyrrolidone | 33.25% |
| ethoxylated trimethylolpropane triacrylate (sold under the name SR454 by the Cray Vallee company) | 19.00% |
| 1-hydroxycyclohexyl phenylketone (sold under the name Irgacure 184 by the Ciba-Geigy company) | 10.00% |
| ethoxylated trimethoxysilane (sold under the name Silane Y 5889 by the Union Carbide company) | 5.00% |

Winding No. 1 was made on a cylindrical barrel provided with a straight lateral edge; winding No. 2 on a tapered barrel also provided with a straight lateral edge. These two windings have a conical shoulder.

TABLE

| Winding | No. 1 | No. 2 |
|---|---|---|
| Cop diameter (mm) | | |
| top, initial | 90 | 98 |
| bottom, initial | 90 | 118 |
| top, final | 150 | 188 |
| bottom, final | 170 | 196 |
| Spindle speed (revolutions/min) | | |
| top, initial | 7852 | 7211 |

TABLE-continued

| Winding | No. 1 | No. 2 |
|---|---|---|
| bottom, initial | 7852 | 5989 |
| top, final | 4711 | 3759 |
| bottom, final | 4157 | 3605 |
| Speed of thread guide (m/min) | | |
| rising, bottom | 6 | 5 |
| rising, top | 8 | 5 |
| descending, top | −12 | −10 |
| descending, bottom | −6 | −10 |
| Length of thread (in m per cm)* | | |
| start of winding | | |
| rising, bottom | 3.7 | 4.4 |
| rising, top | 2.8 | 4.4 |
| descending, top | 1.9 | 2.2 |
| descending, bottom | 3.7 | 2.2 |
| end of winding | | |
| rising, bottom | 3.7 | 4.4 |
| rising, top | 2.8 | 4.4 |
| descending, top | 1.9 | 2.2 |
| descending, bottom | 3.7 | 2.2 |
| Travel of thread guide (mm) | | |
| start of winding | 380 | 375 |
| end of winding | 230 | 205 |
| Angle of winding (degrees) | | |
| interior | 0.0 | 1.5 |
| exterior | 2.5 | 1.1 |
| cone | 11.3 | 14.8 |
| Net weight (kg) | 7.2 | 9.5 |

*See definition in the description.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. Process for producing a tapered glass winding, comprising the steps of:

continuously mechanically drawing a multiplicity of strings of molten glass from orifices of a spinneret;

coating the glass filaments with a size;

gathering the sized filaments into a thread;

using a drawing device over which the thread passes to make uniform the drawing speed of the thread at the drawing device;

winding the thread having a uniform drawing speed on a rotating support via a reciprocating thread guide;

rotatably driving said support using motor having a motor controller;

controlling the speed and length of reciprocating stroke of said thread guide;

using a dancing roller to measure a difference between said drawing speed and a winding speed of said thread on the support; and controlling the motor controller such that the rotational speed of said support is controlled in response to said measured difference, wherein said rotational speed of said support progressively decreases with each successive layer wound on the support and progressively varies between two values during winding of each layer.

2. The process of claim 1, wherein said speed difference measuring step comprises measuring a displacement of an arm carrying the dancing roller and wherein said controlling step comprises controlling the motor controller using a PID regulator.

3. The process of claim 2, including the step of controlling regulating parameters of said PID regulator using the controller.

4. The process of claim 3, wherein said controller receives arm displacement signals from said dancing roller arm.

5. The process of claim 4, wherein said step of controlling regulating parameters of said PID regulator is responsive to the arm displacement signals.

6. The process of claim 1, wherein said drawing speed is at least 10 m/sec.

7. The process of claim 1, wherein said step of controlling the speed of said thread guide comprises varying the thread guide speed between two values.

8. The process of claim 1, wherein said step of controlling the speed of the thread guide comprises:

for initial layers wound on a cylindrical support, varying the thread guide speed such that the initial layers form a taper; and subsequently maintaining a constant thread guide speed.

9. The process of claim 1, wherein said step of controlling the speed of the thread guide comprises maintaining a constant thread guide speed.

10. The process of claim 1, wherein said step of controlling the length of stroke of said thread guide comprises decreasing the length of stroke during at least a part of the winding step.

11. The process of claim 1, wherein said support is cylindrical.

12. The process of claim 1, wherein said support is tapered.

13. The process of claim 1, wherein said filaments have an average diameter of between 5 and 14 μm.

14. The process of claim 1, wherein said size is formed of organic components.

15. The process of claim 1, wherein said support has a flange.

* * * * *